United States Patent [19]

Pinsonnault

[11] 4,017,096

[45] Apr. 12, 1977

[54] SKI HARNESS

[76] Inventor: Maurice Pinsonnault, 770, Boulevard Desaulniers, St-Lambert, Quebec, Canada

[22] Filed: Aug. 8, 1975

[21] Appl. No.: 603,181

[52] U.S. Cl. ..... 280/615

[51] Int. Cl.[2] ..... A63C 9/20

[58] Field of Search ..... 280/11.35 B, 11.35 W, 280/11.35 L, 11.35 P, 11.35 F, 11.35 V, 11.35 G, 615, 614

[56] References Cited

UNITED STATES PATENTS

| | | | |
|---|---|---|---|
| 3,481,618 | 12/1969 | With | 280/615 |
| 3,603,606 | 9/1971 | Eie | 280/615 |
| 3,715,127 | 2/1973 | With | 280/615 |
| 3,823,953 | 7/1974 | With | 280/11.35 B |
| 3,850,439 | 11/1974 | Guttulsrud | 280/11.35 B |
| 3,905,612 | 9/1975 | Kjellstrom | 280/11.35 B |

FOREIGN PATENTS OR APPLICATIONS

| | | | |
|---|---|---|---|
| 283,785 | 4/1915 | Germany | 280/11.35 F |
| 66,413 | 6/1943 | Norway | 280/11.35 B |
| 65,682 | 10/1948 | Norway | 280/11.35 B |
| 99,184 | 6/1940 | Sweden | 280/11.35 B |
| 108,061 | 7/1943 | Sweden | 280/11.35 B |

*Primary Examiner*—Joseph F. Peters, Jr.
*Assistant Examiner*—Milton L. Smith
*Attorney, Agent, or Firm*—Bacon & Thomas

[57] ABSTRACT

A ski harness having a toe-plate and a bail. The toe-plate has a base plate with a pair of spaced-apart flanges extending up from the base plate, and locking means on the base plate in front of the flanges. The bail has means for pivotably, detachably connecting it to the flanges. The bail also has locking means, cooperating with the locking means on the toe plate, to detachably lock the bail to the toe-plate.

27 Claims, 5 Drawing Figures

SKI HARNESS

This invention is directed toward improvements in ski-harnesses.

The invention is more particularly directed toward improvements in toe-clamp type ski-harnesses used in cross-country skiing.

Toe-clamp harnesses are used in cross-country skiing to clamp a ski boot, at its toe end, to a ski. This permits the remainer of the boot to be lifted off the ski to allow the desired cross-country skiing action. Most of these harnesses comprise a toe plate, for receiving the toe of the boot, and a bail, for clamping the toe of the boot to the toe plate.

The bail in the harness is permanently attached to the toe plate. This can present a problem if the harness, and more particularly the bail, is damaged while skiing out in the woods and cannot be replaced. If the ski boot cannot be held on the ski by the bail it is practically impossible to ski. Consequently, a person may have trouble returning from the woods if a bail is damaged.

Another drawback of known toe-clamp type harnesses is that they are made of metal. A metallic harness adds undue weight to the ski equipment. Weight is a problem, particularly to the advanced skier, who tries to use equipment which is as light, yet as strong, as possible. A metallic harness also tends to collect snow during use thus adding further weight to the weight of the equipment.

It is therefore one purpose of the present invention to provide an improved ski-harness which can be readily repaired on the trails if damaged. To this end, the ski harness of the present invention, in one embodiment employs a detachably mounted bail. If the bail is damaged, it can be readily, manually removed from the toe plate without requiring the use of tools and readily replaced with a spare bail carried by the skier.

It is another purpose of the present invention to provide an improved ski-harness which is made from light-weight, snow repelling material. Preferably, the harness is molded from thermoplastic material. The toe plate of the harness is preferably modified, when made from thermoplastic material, at the locations where the bail is attached, to provide the required strength to locate the bail and retain it in position.

The harness having a detachably mounted bail can be made from any material; and the harness, made from light-weight, snow-repellant material, can have a permanently attached bail. In a preferred embodiment however, the harness of the present invention is made from light-weight, snow-repellant material, preferably thermoplastic material, and employs a detachably mounted bail. The bail is preferably made from resilient thermoplastic material since resiliency is preferably employed in detachably mounting the bail.

It is still another purpose of the present invention to provide novel locking means in a ski harness for locking the bail to the toe plate to clamp a ski boot in the harness. The locking means employed are simple, yet effective; and preferably are designed so that they can be operated manually or with a ski pole.

The ski harness of the present invention is simple to construct and operate, and is reliable in operation.

The invention is directed toward a ski harness having a toe-plate and a bail. The toe-plate has a base plate with a pair of spaced-apart flanges extending up from the base plate, and locking means on the base plate in front of the flanges. The bail has means for pivotably, detachably connecting it to the flanges. The bail also has locking means, cooperating with the locking means on the toe plate, to detachably lock the bail to the toe-plate.

The invention is further directed to a ski harness having a toe-plate and a bail. The toe-plate has a base plate with a pair of spaced apart flanges extending up from the base plate, and locking means on the base plate in front of the flanges. The bail has means for pivotably connecting it to the flanges, and locking means, cooperating with the locking means on the toeplate, to detachably lock the bail to the toeplate. Means are provided on the bail for use in operating the locking means with a ski pole.

The invention is still further directed toward a ski harness having a toe plate and a bail. The toe plate has a base plate and a pair of spaced-apart flanges extending up from the base plate and locking means on the base plate in front of the flanges. The bail has means for pivotably connecting it to the flanges, and locking means cooperating with the locking means on the toe-plate to detachably lock the bail to the toe plate. The flanges are angled to have their front ends closer together than their rear ends. Thickened portions are provided in the flanges midway between their ends, in which portions the bail is pivotably mounted. The thickened portion in one flange has at least one bearing surface which surface is parallel to a bearing surface on the thickened portion in the other flange.

The invention in one embodiment is also directed toward a bail for a toe-clamp type of ski harness which bail has a generally Y-shaped configuration with a main central leg and two arms branching from one end of the main leg. The branching arms each have means for pivotably, detachably connecting the bail to a portion of the ski harness. The main leg has means for use in detachably locking the bail to the portion of the ski harness, when the bail is attached to the harness, to clamp a ski boot in the harness with the bail.

At least the arms of the bail, and preferably the entire bail, are made from resilient material. The resilient material is preferably a thermoplastic material.

The invention in another embodiment is directed toward a bail for a toe-clamp type of ski harness with the bail having a generally Y-shaped configuration with a main central leg and two arms branching fromm one end of the leg. Means are provided on the arms for use in pivotably connecting the bail to a portion of the harness. The main leg has means for use in detachably locking the bail to the portion of the ski harness when the bail is connected to the harness to clamp a ski boot in the harness with the bail. Means are provided on the main leg for use in operating the locking means with a ski pole.

The above harness is preferably made from thermoplastic material.

The invention will now be described in detail and in a non-limitative way having reference to the accompanying drawings in which.

Figure 1:
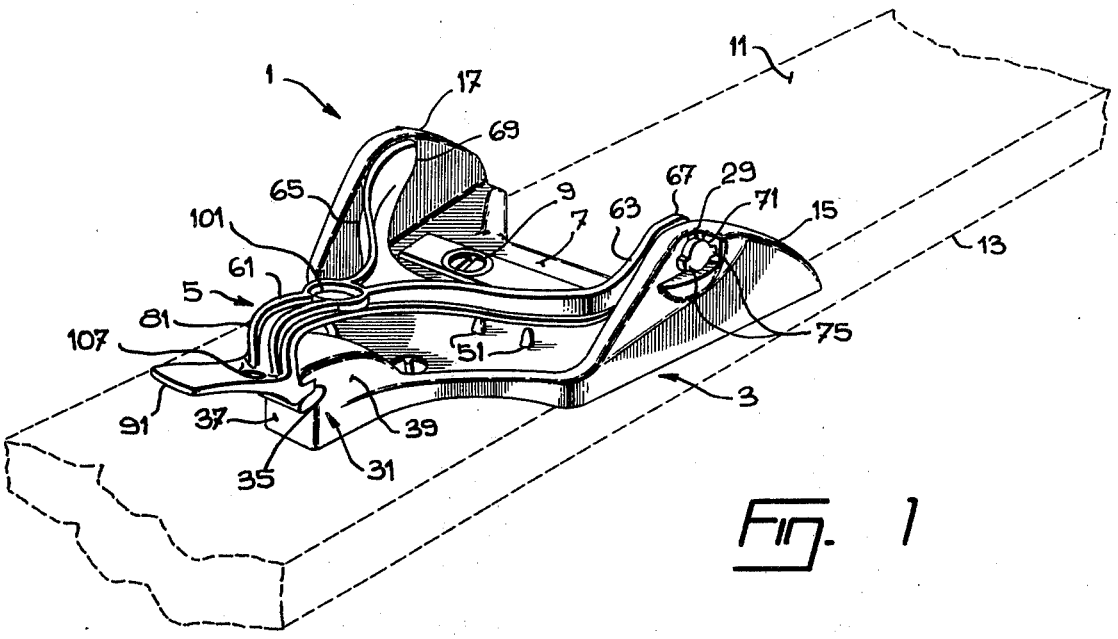
FIG. 1 is a perspective view of the ski harness of the present invention.
Figure 2:
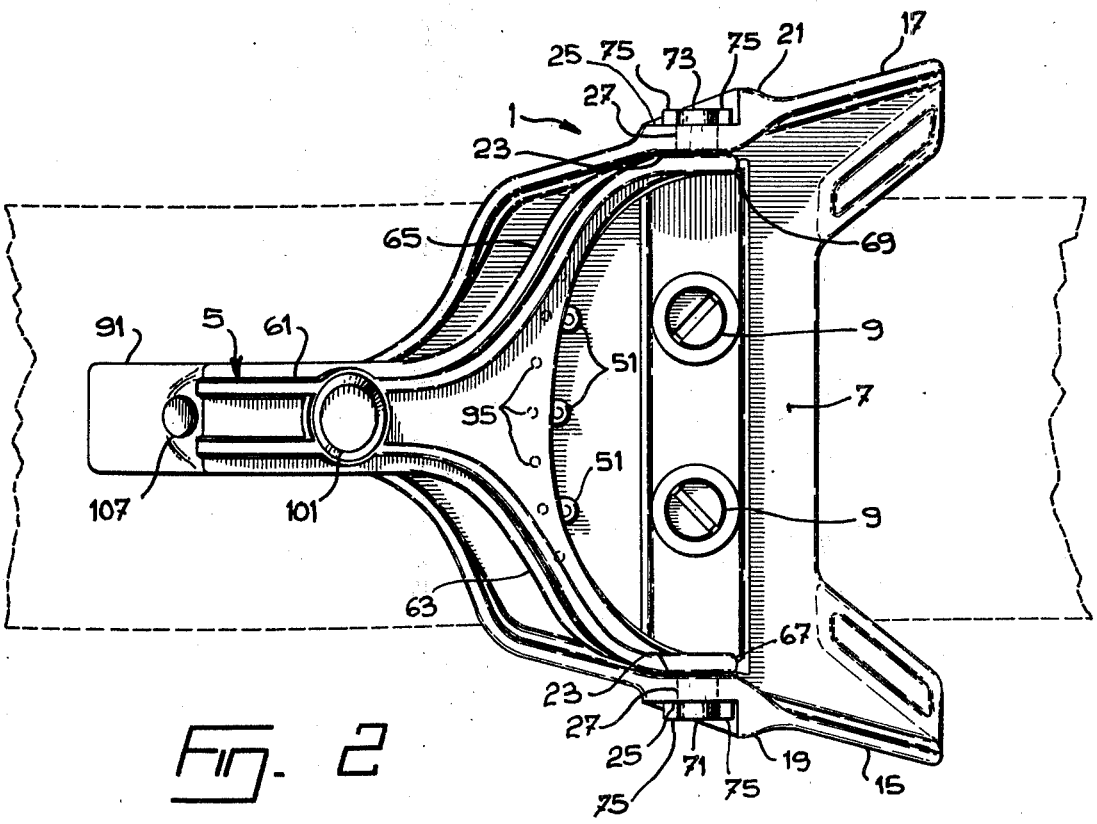
FIG. 2 is a plan view of the ski harness.
Figure 3:
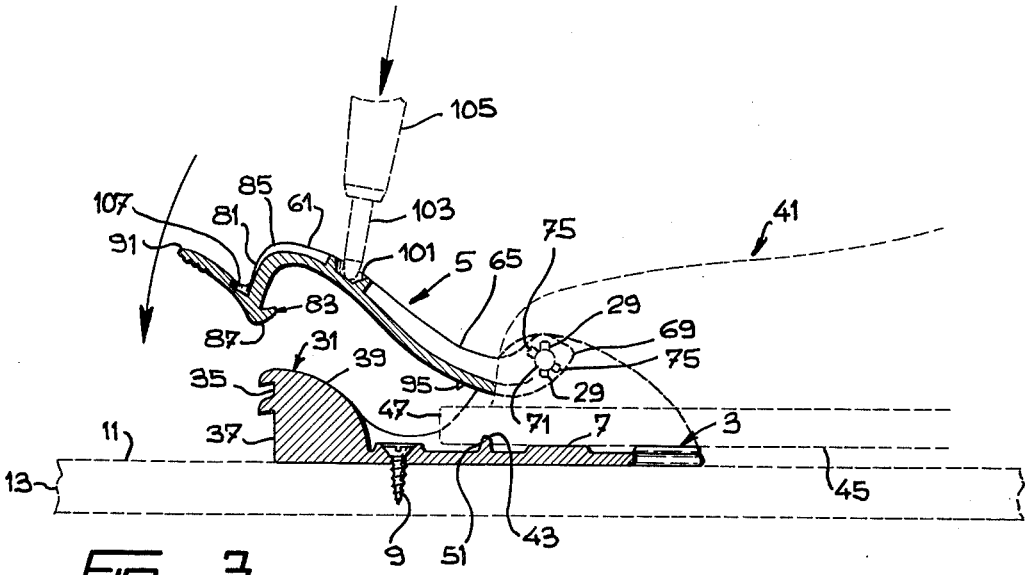
FIGS. 3 to 5 are cross-sectional, elevation views of the ski harness showing respectively, how it is operated to clamp a ski boot, how it clamps the boot, and how it is operated to unclamp the boot.
Figure 4:
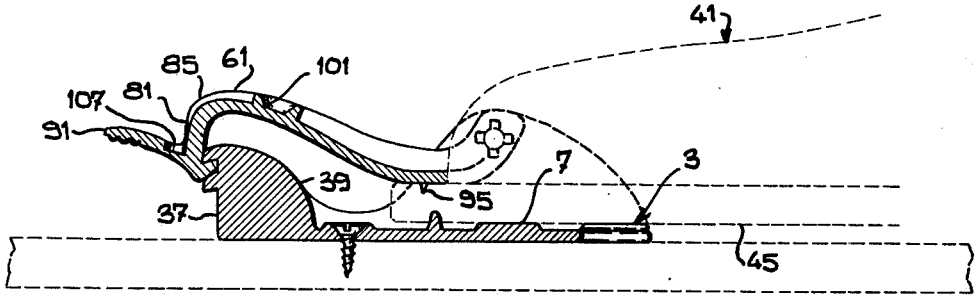
Figure 5:
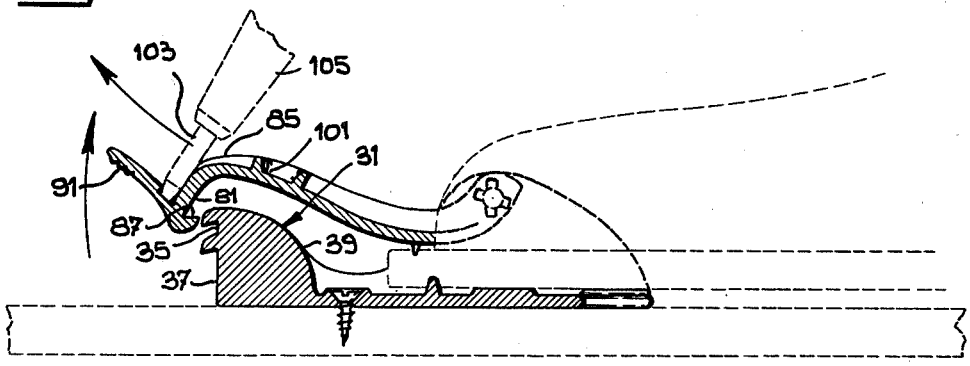

The ski harness 1 of the present invention is of the toe-clamp type employed in cross-country skiing. The harness 1 comprises a toe plate 3 and a bail 5.

The toe plate 3 has base plate 7. Screws 9 connect the toe plate 3, via base plate 7, onto the top surface 11 of a cross-country ski 13. The toe plate 3 has two flanges 15, 17 extending up from the sides of base plate 7. The flanges 15, 17 are both angled slightly relative to ski 13 to have their front ends closer together than their rear ends.

Each flange 15, 17 is provided with a thickened portion 19, 21 midway between its ends. The thickened portion 19, 21 on each flange is located above the base plate 7 and each thickened portion 19, 21 has an inner and outer bearing surface 23, 25. The bearing surfaces 23, 25 on each flange are substantially parallel to each other, and also substantially parallel to the surfaces on the other flange. The thickened portions provide reinforcement for the flanges which is particularly important when the harness is made from thermoplastic material. The thickened portions 19, 21 make the flanges more rigid and provide room for the parallel bearing surfaces. These parallel bearing surfaces 23, 25 minimize a tendency for the bail to spread the flanges apart.

A hole 27 extends transversely through each flange 15, 17 in the approximate center of each thickened portion 19, 21 and in the center of the bearing surfaces. The axis of the transverse holes 27 are aligned. Each hole 27 also has a pair of diametrically opposed, longitudinal through grooves 29 which grooves 29 are substantially parallel to the axis of the holes. The holes 27 are used in pivotably mounting the bail 5 on the toe plate 3 as will be described.

The toe plate 3 also includes locking means 31 at its front end for cooperating with locking means on the bail 5 to have the bail locked in a clamping position on a ski boot as will be described. The locking means 31 preferably comprises a forwardly facing, horizontal groove 35 in the front vertical face 37 of a narrow, raised projection 39 extending forwardly from the front of the base plate 7. The groove 35 extends substantially transversely to the ski and is located slightly above base plate 7.

The ski boot 41 preferably is of the type having a row of holes 43 in the bottom of the sole 45 adjacent the toe 47 of the boot. A row of projections 51 are provided on the upper surface of base plate 7 near its front end which projections 51 fit into the holes 43 to position and help retain the ski boot in 41 on the ski 13. When the projections 51 fit in the holes, the boot is wedged between flanges 15, 17 and rests on base plate 7.

Bail 5 is provided to clamp the boot in the toe plate in the above position. The bail 5 has a substantially Y-shape with a main central leg 61 and two arms 63, 65 branching off one end of leg 61. The arms 63, 65 bend toward each other at their end portions 67, 69 so that the end portions are substantially parallel to one another. Mounting studs 71, 73 are provided on the end portions 67, 69. The studs 71, 73 are cylindrical and project laterally from the outer surface of end portions 67, 69, aligned on the same axis. Two diametrically opposed lugs 75 are provided on the free ends of each of the studs 71, 73. The lugs 75 extend radially from each stud, transverse to the axis of the studs. The width between the outer surfaces of end portions 67, 69 is substantially equal to the width between the inner bearing surfaces 23 on the flanges; and the length of the studs 71, 73 between arms 63, 65 and lugs 75 is slightly greater than the width between the inner and outer bearing surfaces 23, 25.

The free end portion 81 of the leg 61 of the bail 5 is provided with locking means 83 which cooperate with the locking means 31 on toe plate 3. The leg 61 is preferably bent at 85 to have the free end portion 81 extend generally transversely to the remainder of bail 5. The locking means 83 comprises a lug 87 which projects laterally from the inner face of free end portion 81. The lug 87 extends transversely across portion 81. The lug 87 extends transversely across portion 81 and fits in groove 35 in locking means 31 to lock the bail 5 to toe plate 3 as will be described. A tab 91 can project from the outer face of end portion 81 opposite to lug 87. The tab 91 can be used to lock and unlock lug 87 and groove 35.

In accordance with the invention at least the arms 63, 65 of bail 5 are made of resilient material. Preferably, it is the entire bail 5 which is made from suitably resilient material, such as resilient, thermoplastic material. The toe plate 3 can also be made from thermoplastic material, but which material is more rigid than the bail material. Both the bail 5 and the plate 3 are preferably molded. To assemble the harness 1 the resilient arms 63, 65 of bail 5 are moved together and positioned within flanges 15, 17 to have the lugs 75 on studs 71, 73 adjacent, and aligned with, grooves 29 of holes 27. The arms 63, 65 are then allowed to move away from one another to a normal relaxed position, with studs 71, 73 passing through holes 27 and lugs 75 passing in grooves 29. When the lugs 75 clear the grooves 29 the bail 5 is rotated about studs 71, 73 and lugs 75 now retain the bail in place. The lugs 75 bear on surfaces 25 and the outer surface of arms 63, 65 bear on surfaces 23.

It will be seen that if the bail 5 breaks for any reason, it can be readily replaced with another spare bail.

To clamp the ski boot 41 onto the ski 13 when positioned within toe plate 3 as previously described, it is only necessary to move the bail 5 down into a locking position with the plate 3. When the bail 5 is locked, it bears down in the vicinity where its arms 63, 65 meet against the edge of the sole 45 of the boot to clamp the boot in place. When the bail 5 is moved down, by pushing on tab 91 or arm 61 for example, it rotates about studs 71, 73 and lug 87 is forced past the front of projection 39. The lug 87 can be forced past the projection 39 because with this type of locking means the entire bail is made of resilient material. Continued downward movement of bail 5 snaps lug 87 into groove 35 locking the bail 5 in a clamped position. If desired, the bail can be provided with teeth 95 on its bottom surface in the vicinity where it contacts the ski boot to provide more positive clamping.

The bail 5 is unlocked to release the ski boot by merely lifting up on tab 91 to first pivot end portion 81 of bail 5 about bend 85, to remove lug 87 from groove 35, and then to pivot bail 5 up from boot 41.

Means can be provided, if desired, to lock and unlock the bail 5 with a ski pole. As shown in the drawings, a socket 101 can be provided in the leg 61 of the bail 5 opening upwardly. The socket 101 receives the tip 103 of a ski pole 105. When the ski pole 105, with its tip 103 in socket 101, is pressed down, it forces the bail 5 down about its pivot studs 71, 73 and also forces lug 87, of the bail's locking means 83 down over the front of projection 39 of locking means 31 on the plate 3 as before. The bail 5 is forced down until lug 87 snaps into groove 35 to lock the bail while clamping boot 41. A second socket 107 can be provided in tab 91 adjacent the end portion 81 of bail 5. This socket is used to unlock the bail. The tip 103 of pole 105 is placed in socket 107 and the pole is then levered about bend 85 to pivot lug 87, about bend 85, out of groove 35. Once this has been done, the boot can be readily removed from the harness.

While one type of bail locking means has been described in detail it will be obvious that other types of locking means can be used with the detachably mounted bail.

The specific bail locking means described can however also be used with fixedly mounted bails.

I claim:

1. A ski harness having a toe plate and a one-piece bail; the toe plate having a base plate; a pair of spaced-apart flanges extending up from the base plate; locking means on the base plate in front of the flanges the one-piece bail having means integral therewith for pivotably, detachably connecting it at one end thereof to the flanges; and projecting lug locking means on the other end of the one-piece bail and integral therewith, directly engageable with the locking means on the toe plate, to detachably lock the one-piece bail to the toe plate.

2. A ski harness as claimed in claim 1 wherein the one-piece bail has a pair of branching arms, the connecting means comprising a pivot stud on the outer surface of each arm for mounting in a respective flange, and lugs for retaining the studs in the flanges.

3. A ski harness as claimed in claim 2 wherein at least the arms of the one-piece bail are made of resilient material.

4. A ski harness having a toe plate and a one-piece bail; the toe plate having a base plate; a pair of spaced-apart flanges extending up from the base plate; locking means on the base plate in front of the flanges; the one-piece bail having means integral therewith for pivotably connecting it at one end thereof to the flanges; locking means on the other end of the one-piece bail and integral therewith, directly engageable with the locking means on the toe plate to detachably lock the one-piece bail to the toe plate; and means on the one-piece bail for use in operating the locking means with a ski pole.

5. A ski harness as claimed in claim 4 wherein at least the one-piece bail is made of resilient material.

6. A ski harness having a toe plate and a bail; the toe plate having a base plate; a pair of spaced-apart flanges extending up from the base plate; locking means on the base plate in front of the flanges; the bail having means for pivotably, detachably connecting it to the flanges, and having a generally Y-shaped configuration with a main central leg and two arms branching from one end of the leg, the main leg being bent to have its free end portion extending at an angle to the remaining portion of the leg; and locking means on the bail, cooperating with the locking means on the toe plate, to detachably lock the bail to the toe plate, the locking means on the bail being located on the inner surface of the free end portion and comprising a projecting lug.

7. A ski harness as claimed in claim 6 wherein the locking means on the toe plate comprises a raised projection on the front of the base plate, the projection having a groove in its front surface for receiving the lug on the bail.

8. A ski harness having a toe plate and a bail; the toe plate having a base plate; a pair of spaced-apart flanges extending up from the base plate; locking means on the base plate in front of the flanges; the bail having means for pivotably connecting it to the flanges, and having a generally Y-shaped configuration with a main central leg and two arms branching from one end of the leg, the main leg being bent to have its free end portion extending at an angle to the remaining portion of the leg; locking means on the bail, cooperating with the locking means on the toe plate to detachably lock the bail to the toe plate; and means on the bail for use in operating the locking means with a ski pole, at least the bail being made of resilient material the operating means comprising a first socket opening outwardly on the remaining portion of the leg and a second socket adjacent the outer surface of the free end portion of the leg, and spaced from the remaining leg portion, the second socket opening in the same direction as the first socket.

9. A ski harness having a toe plate and a bail; the toe plate having a base plate; a pair of spaced-apart flanges extending up from the base plate; locking means on the base plate in front of the flanges; the bail having means for pivotably connecting it to the flanges; locking means on the bail cooperating with the locking means on the toe plate, to detachably lock the bail to the toe plate, the flanges being angled to have their front ends closer together than their rear ends, thickened portions in the flanges midway between their ends in which the bail is mounted, the thickened portion in one flange having at least one bearing surface which surface is parallel to a bearing surface in the thickened portion in the other flange.

10. A ski harness as claimed in claim 9 wherein the harness is made from thermoplastic material.

11. A ski harness as claimed in claim 10 wherein the bail is made from resilient thermoplastic material.

12. A ski harness as claimed in claim 9 wherein the bail has means for detachably connecting it to the flanges.

13. A one-piece bail for a toe-clamp type of ski harness; the one-piece bail having a generally Y-shaped configuration with a main central leg and two arms branching from one end of the leg; means on the rear ends of the branching arms and integral therewith for use in pivotably, detachably connecting the one-piece bail to a portion of the ski harness; and downwardly and rearwardly projecting lug means on the front end of the main leg and integral therewith for use in detachably locking the one-piece bail to a portion of the ski harness when the bail is connected to the harness to clamp a ski boot in the harness with the bail.

14. A bail as claimed in claim 13 wherein at least the arms are made of resilient material.

15. A bail as claimed in claim 13 wherein the bail is made of resilient material.

16. A bail as claimed in claim 14 wherein the pivotably, detachable connecting means comprise a pivot stud projecting from the outside surface of each arm, the axis of the two studs being aligned, and holding lugs on the free end of each stud.

17. A bail for a toe-clamp type of ski harness; the bail being made of resilient material and having a generally Y-shaped configuration with a main central leg and two arms branching from one end of the leg, the main leg being bent to have its free end portion extend at an angle to the remaining portion of the leg; means on the branching arms for use in pivotably, detachably connecting the bail to a portion of the ski harness; and means on the main leg for use in detachably locking the bail to the portion of the ski harness when the bail is connected to the harness to clamp a ski boot in the harness with the bail, the detachable locking means being located on the inner surface of the free end portion and comprising a projecting lug.

18. A bail as claimed in claim 17 including a first socket opening outwardly on the remaining portion of the leg and a second socket adjacent the outer surface of the free end portion of the leg, opposite the lug, and spaced from the remaining leg portion, the second socket opening in the same direction as the first socket, the first socket and the second sockets being provided respectively for locking and unlocking the bail with a ski pole.

19. A bail as claimed in claim 13 made from thermoplastic material.

20. A one-piece bail for a toe-clamp type of ski harness, the one-piece bail having a generally Y-shaped configuration with a main central leg and two arms branching from one end of the leg; means on the rear ends of the branching arms and integral therewith for use in pivotably connecting the one-piece bail to a portion of the ski harness; downwardly and rearwardly projecting lug means on the main leg and integral therewith for use in detachably locking the one-piece bail to a portion of the ski harness when the bail is connected to the harness to clamp a ski boot in the harness with the bail; and means on the main leg on both sides of the lug means for use in operating the locking means with a ski pole.

21. A bail as claimed in claim 20 wherein the bail is made of resilient material.

22. A bail for a toe-clamp type of ski harness, the bail being made of resilient material and having a generally Y-shaped configuration with a main central leg and two arms branching from one end of the leg, the main leg being bent to have its free end portion extend at an angle to the remaining portion of the leg; means on the arms for use in pivotably connecting the bail to a portion of the ski harness; means on the main leg for use in detachably locking the bail to the portion of the ski harness when the bail is connected to the harness to clamp a ski boot in the harness with the bail, the detachable locking means being located on the inner surface of the free end portion and comprising a projecting lug; and means on the main leg for use in operating the locking means with a ski pole.

23. A bail as claimed in claim 22 wherein the operating means comprise a first socket opening outwardly on the remaining portion of the leg and a second socket adjacent the outer surface of the free end portion of the leg, opposite the lug, and spaced from the remaining leg portion, the second socket opening in the same direction as the first socket.

24. A ski harness as claimed in claim 4, wherein said bail is provided with teeth on its bottom surface in the vicinity where it contacts a ski boot to provide more positive clamping.

25. A ski harness as claimed in claim 4, wherein a row of projections are provided on the upper surface of the base plate near its front end, said projections being adapted to fit into a row of holes provided in the bottom of the sole of a ski boot, adjacent the toe of said boot.

26. A ski harness as claimed in claim 1, wherein the base plate is connected to a ski by screws.

27. A ski harness according to claim 2, wherein each of said flanges of the toe plate has a hole provided with grooves, said studs of the bail passing through said holes and said lugs passing through said grooves when the branching arms of the bail are allowed to move away from one another to a normal relaxed position after being moved towards each other during the fitting of the bail into said toe plate, the bail being afterwards rotated about said studs in order to provide the bearing of said lugs on outer bearing surfaces of the flanges thus providing the assembling of the bail with the toe plate.

* * * * *